United States Patent [19]

Lipperts

[11] 4,323,590

[45] Apr. 6, 1982

[54] METHOD FOR IMPROVING SWITCH CONTACTS, IN PARTICULAR FOR VACUUM SWITCHES

[75] Inventor: Joseph H. Lipperts, Hengelo, Netherlands

[73] Assignee: Hazemeijer B. V., Hengelo, Netherlands

[21] Appl. No.: 170,925

[22] Filed: Jul. 21, 1980

[30] Foreign Application Priority Data

Jul. 24, 1979 [NL] Netherlands ..... 7905720

[51] Int. Cl.[3] ..... B05D 3/06

[52] U.S. Cl. ..... 427/38; 200/144 B; 200/262; 200/266; 200/267; 200/268; 427/77

[58] Field of Search ..... 427/38, 35, 36, 77, 427/78; 200/144 B, 262, 266, 267, 268

[56] References Cited

U.S. PATENT DOCUMENTS

| | | | |
|---|---|---|---|
| 3,245,895 | 4/1966 | Baker et al. | 427/38 |
| 3,566,463 | 3/1971 | Kobayashi et al. | 200/266 |
| 3,961,148 | 6/1976 | Abele | 200/266 |
| 4,243,859 | 1/1981 | Peche | 200/144 B |

*Primary Examiner*—John H. Newsome

*Attorney, Agent, or Firm*—Watson, Cole, Grindle & Watson

[57] ABSTRACT

Method for improving switch contacts in particular enhancing the voltage endurance, lowering the chopper level and improving the electrical conductivity for the use in vacuum switches in which ions are implanted of material improving the above said characteristics, at least in the surface area of the switch contacts where upon switching action a discharge is generated.

5 Claims, No Drawings

METHOD FOR IMPROVING SWITCH CONTACTS, IN PARTICULAR FOR VACUUM SWITCHES

The invention relates to a method for improving switch contacts, in particular for increasing the voltage endurance, reducing the chopper level and improving the electrical conductivity, for use in vacuum switches.

Very often conflicting requirements are made upon switch contacts of switches, in particular vacuum switches. Maintenance for instance has to be omitted completely and a long life is a demand. Switch contacts have to endure high switch frequencies and extremely short switch-in times, whereas chopping should be avoided as much as possible. In particular switch contacts in vacuum should emit as less as possible gases, also upon interrupting high currents.

The above demands result in particular characteristics of switch contacts and these characteristics are determined by the used metals, the structure and manufacturing method. Because many of the demands in general cannot be satisfied, switch contacts usually are composed of several materials, such as Cu, W, Mo, Ag, Cr, Be, etc.

Until now for each particular use the necessary materials are composed by alloying, sintering or plating. However, these methods are subject to several disadvantages. For instance the relation between the component portions in one alloy is greatly dependent on these alloys, so that not each required composition can be obtained. This relation is determined for instance by the chemical solvability of the materials, depends on the thermical balance, whereas some relations are excluded by possible mutual chemical reactions of the materials. Upon sintering and plating similar problems arise, where moreover a machining of the obtained workpieces is necessary.

All contact materials developed until now, comprising binary and tertiary alloys on Cu-base or sintered binary and tertiary alloys on Cu-base show the further disadvantage of a significally lower electrical conductivity compared with the original copper. Moreover, most used contacts are of a geometry, which requires at least some millimeters material thickness.

The main reason that notwithstanding the above usually alloying is used is based on the demand to control the influence of the so called chopping. Upon using low alloyed Cu-alloys (1–2% by weight addition) the influence of this alloy on chopping is low. Only in case of higher alloyed Cu-alloys (equal to or more than 10% by weight addition) a clearly perceivable influence of the chopper level can be noticed.

One of the disadvantages of these higher alloyed Cu-alloys is, as remarked above, a significantly reduced electrical conductivity with respect to the original copper. For example BeCu having 0.8% by weight Be shows a reduction of 50% in the electrical conductivity with respect to pure copper.

One obvious solution is to apply an extremely thin layer of some tenths of microns of this high alloyed copper, for instance galvanically, evaporation, etc. One main disadvantage hereof is, that the adherence of the foreign layer on the contacts of pure copper very often is insufficient, whereas the mutual adherence of the particles in the applied layer can be very loose. This may result in loose metal particles in the vacuum switch, which particles disastrously may attack the electrical insulation between the open contacts.

Summarizing the known switch contacts and the manufacturing methods of these contacts show the following disadvantages: the most suitable alloy composition of the contact materials cannot always be obtained; Cu-alloys are of low conductivity; the adherence of the applied thin alloy layers is bad or insufficient; Cu shows an insufficient dielectric endurance under certain circumstances and a high chopper level.

Above and other disadvantages are now avoided by the method for improving switch contacts of the present invention, characterized in that at least in the surface areas of the switch contacts where upon switching actions a discharge takes place, ions are implanted of at least one of the materials improving the characteristics as mentioned above.

The method of the present invention results in an extremely thin layer, having particularly favourable switch characteristics in vacuum. It is assumed, that locally such high temperature can be reached by the high collision energy, that some sort of surface alloying takes place, in which atoms of the original contact material are replaced by implanted ions. This may result in characteristics which cannot be realized by classical metallurgical processes. The applied layers are extremely thin, so that the electrical conductivity practically will not be influenced, however, this thin layer may influence the behaviour over a much larger depth than the net-penetration. Also the freedom of choice of alloy component portions is nearly unlimited. Gaseous contaminations can be doped extremely accurately. Binary or tertiary or even more complicated surface alloys can be brought about likewise. Machining of switch contacts can be omitted completely.

Ion implantation is a technique used for several years already, among other to dope semi-conductors more quantitatively with extremely low concentrations than possible before. Also for several years the mechanical characteristics of for instance drills, draw plates and toothed wheels are improved by means of $N_2$-ions, resulting in a higher durability against friction, wear and corrosion.

However, switch contacts for vacuum switches should fulfil other characteristic requirements, in which durability against friction does not play a part. Friction between the contacts has to be avoided completely, because it is totally impossible to use material with lubricating characteristics in a vacuum switch. Switch contacts are mainly exposed to discharges upon switching and surprisingly it appeared that extremely thin implantation layers offer a very good solution for the different problems.

Discharges in vacuum can be divided in two types, viz. a diffuse discharge and a concentrated discharge.

The diffuse discharge consists of a number of conically shaped plasma pillars, positioned above the cathode spots, wherein electrons, neutral particals and ions are emitted. In case of Cu it applies, that until about 100 amperes one spot will be generated. Above this current value the spot will split up, so that at a nominal current value of for instance 5000 amperes an average of 50 cathode spots will appear. This increase in the number of spots as a function of the current value is not unlimited, however. Dependent on the contact diameter, contact distance and contact material a concentrated discharge will appear at about 10 kAmp, in which a great number of cathode spots unite in one pillar. Such a pillar has a considerably larger light intensity and energy intensity than in a diffuse discharge, whereas the arc voltage, which in case of a diffuse discharge will be about 20 Volts, will amount to ±180 Volts. Such concentrated discharge may result locally in a strong contact erosion.

By suitable measures, for instance the generation of an axial magnetic field of suitable magnitude, the diffuse discharge can be maintained over a much larger current area until for instance 30 kAmp, maintaining at the same time the low arc voltage and the low contact erosion, using switch contacts, which are manufactured according to the above discussed known methods.

By using switch contacts obtained with the method of the present invention contact erosion can be much further reduced, while the other above mentioned characteristics can be improved considerably. This results in a much longer life of vacuum switches, which may conduct higher nominal currents and/or which may result in a much higher switching capability, while a better voltage endurance and lower chopper level is obtained.

The ion implantation preferably will be conducted in a high vacuum of $10^{-4}$–$10^{-7}$ mbar, in which ions are produced of a predetermined atom species, which thereupon, dependent on the particular use, are accelerated by a power between about 20 and 600 keV. Using this power the ions are shot within the contact surface. The penetration depth is dependent on the ion species, the ion energy and the target material, i.e. the pure original contact material, and may vary between about 0.1 and 1.0 micron.

In general the base material of the switch contacts will consist of pure copper. In the present invention preferably it will be used for the ion implantation the known alloying materials, such as Cr, Fe, Zr, Ti, V, Be, Co, Si, Ni, Ta, W, Mo and possible combinations hereof.

However, the method of the present invention is not limited to these usual alloying materials.

The method of the present invention will now be further elucidated by means of an example, in which Cr52 is implanted in Cu.

Use is made of an implantation chamber with accelerator on the type HVEE and an acceleration voltage of 300 kV. The resolution of the mass separator amounted to $M/\Delta M=500$. A modified type HVEE 911 A was used as an ion source. The material to be evaporated consisted of sintered chrom nitride (CrN).

A vacuum chamber was used with a cooling trap of liquid $N_2$, in which an operation pressure within the system was maintained lower than or equal to $3\times10^{-6}$ mbar.

The ray executed a scanning movement across the target, viz. an area of $70\times70$ mm$^2$, brought about by means of magnetical deflection means.

The number of particles was measured by means of a current integrator and a target voltage of +120 V. The particles reached an energy of 340 keV.

With a penetration depth of 0.3 micron the total volume in which particles of Cr52 were implanted amounted to $3\times10^{-3}0.2827$ mm$^3$=0.848 mm$^3$.

The method was continued until the concentration of implanted particles amounted to at least 10% by weight.

It is self-evident, that the invention is not restricted to the above values and devices of the above explained example. Also the base material need not be pure copper. Further another, in particular a higher concentration of implanted ions can be used. The implantation process can be continued until a dose of at least $1\times10^{17}$ ions/cm$^2$ is obtained.

Extremely good results are obtained by the method of the present invention, in which the favourable characteristics of alloys are maintained, but the unfavourable characteristics such as low conductivity and low voltage endurance are avoided and maintained at the level of pure copper.

I claim:

1. A method for forming vacuum switch contacts, comprising:

implanting ions of a material, or a combination of materials, taken from the group consisting of Cr, Ti, Be, Si, Ni, or Ta, into the discharge area of switch contacts to a depth of 0.1 to 1.0 microns; and continuing said ion implantation until the concentration of said ion material amounts to at least 10% by weight of the switch contact.

2. Method as claimed in claim 1 wherein the implantation is carried out by an ion ray accelerator with a power between about 20 and 600 keV and a pressure in the implantation chamber between about $10^{-4}$ and $10^{-7}$ mbar.

3. Method of claim 1 or 2 wherein the implantation is continued until a dose is reached of at least $1\times10^{17}$ ions/cm$^2$.

4. Method of claim 2 wherein the implantation material consists of Cr52 and that an ion ray with this material is generated of about 340 keV at a pressure in the implantation chamber of $3.10^{-6}$ mbar.

5. Method of claim 1 or 2 wherein during implantation the ion ray executes a relative scanning movement with respect to the contact surface.

* * * * *